US010066853B2

(12) United States Patent
Moon

(10) Patent No.: US 10,066,853 B2
(45) Date of Patent: Sep. 4, 2018

(54) COUPLING STRUCTURE OF A CASE AND AN AIR HEATER BODY IN AN AIR HEATER

(71) Applicant: PASECO CO., LTD., Ansan-si (KR)

(72) Inventor: Won Jae Moon, Siheung-si (KR)

(73) Assignee: PASECO CO., LTD., Ansan-si (KR)

( * ) Notice: Subject to any disclaimer, the term of this patent is extended or adjusted under 35 U.S.C. 154(b) by 280 days.

(21) Appl. No.: 15/045,949

(22) Filed: Feb. 17, 2016

(65) Prior Publication Data

US 2016/0265809 A1 Sep. 15, 2016

(30) Foreign Application Priority Data

Mar. 13, 2015 (KR) ..... 10-2015-0035160

(51) Int. Cl.
*F24H 9/14* (2006.01)
*F24H 3/02* (2006.01)

(52) U.S. Cl.
CPC ..... *F24H 9/14* (2013.01); *F24H 3/025* (2013.01)

(58) Field of Classification Search
CPC ..... F24H 3/025; F24H 9/14
USPC ..... 126/67, 72
See application file for complete search history.

(56) References Cited

U.S. PATENT DOCUMENTS 5,204,509 A * 4/1993 Etters ..... H01H 1/62 219/201
9,267,704 B1 * 2/2016 Lee, Jr. ..... F24H 3/02
2016/0178238 A1 * 6/2016 Chen ..... F24H 9/124 137/337

FOREIGN PATENT DOCUMENTS

CA 2795946 A1 * 10/2011 ..... F24H 3/0488
KR 1997-0005182 5/1997
KR 10-2004-0081968 9/2004
KR 101031642 B1 * 4/2011
KR 10-1491633 2/2015

* cited by examiner

*Primary Examiner* — Avinash Savani
*Assistant Examiner* — Aaron Heyamoto
(74) *Attorney, Agent, or Firm* — Hamre, Schumann, Mueller & Larson, P.C.

(57) ABSTRACT

The present invention relates to a coupling structure of a case and an air heater body in an air heater, and the coupling structure includes: an air heater body for generating flames with the fuel supplied from a fuel tank and forcedly blowing the heat of the flames to the outside; the case detachably coupled surroundingly to the air heater body; fastening screws for unitarily coupling the air heater body and the case to each other; coupling flanges formed on both sides of the case in a longitudinal direction of the case and having first screw coupling holes screw-coupled to the fastening screws; and coupling brackets located on one side and the other side of the air heater body in the longitudinal direction of the air heater body in such a manner as to come into surface contact with the coupling flanges and having second screw coupling holes formed thereon correspondingly to the first screw coupling holes.

3 Claims, 6 Drawing Sheets

COUPLING STRUCTURE OF A CASE AND AN AIR HEATER BODY IN AN AIR HEATER

BACKGROUND OF THE INVENTION

Field of the Invention

The present invention relates to a coupling structure of a case and an air heater body in an air heater, and more particularly, to a coupling structure of a case and an air heater body in an air heater that improves the coupling structure between the case and a body of the air heater to enhance the assemblability and fixing force between the case and the air heater body.

Background of the Related Art

Generally, an air heater is a device using an electric heating way in which a heater or heating cable made of a coil is provided in a body thereof and air sucked thereinto is heated to a relatively high temperature by the application of power to the heater or heating cable to send the heated air to the outside through a blower fan, or having a combustion heating way in which high temperature heat generated through the combustion of fuel in a combustion chamber is sent to the outside through a blower fan.

The electric heating type air heater is typically used to raise indoor temperatures of general houses, and the combustion heating type air heater is used when hot air is required in factories or closed places, to provide greenhouse effects for greenhouses, or to remove moisture from barns.

Hereinafter, an explanation on a structure for coupling a case to an air heater in a conventional practice will be given with reference to FIG. 1.

As shown, the conventional structure includes a fuel tank 10 for storing a fuel for combustion therein, an air heater body 20 for generating flames with the fuel supplied from the fuel tank 10 and forcedly blowing the heat of the flames to the outside, and a case 30 coupled surroundingly to the air heater body 20 and having discharge outlets formed thereon to discharge the heat of the flames to the outside.

Further, the case 30 includes an upper case 31 and a lower case 32 detachably coupled to each other in such a manner as to place the air heater body 20 therebetween, and the upper case 31 and the lower case 32 have first screw fastening holes 34 fastened to fastening screws 33.

Furthermore, the air heater body 20 has fixing brackets 21 adapted to rigidly fix the lower case 32 thereto, and the lower case 32 further has second screw fastening holes 35 screw-fastened to the fixing brackets 21.

According to the conventional structure, by the way, the upper case 31 and the lower case 32 have the first screw fastening holes 34 screw-fastened to the fastening screws 33, and further, the lower case 32 has the second screw fastening holes 35 screw-fastened to the fixing brackets 21. Accordingly, the number of manufacturing processes and the number of assembling processes are all increased. Additionally, it is hard to constantly maintain the distance between each first screw fastening hole 34 and each second screw fastening hole 35, thus substantially reducing the productivity.

SUMMARY OF THE INVENTION

Accordingly, the present invention has been made in view of the above-mentioned problems occurring in the prior art, and it is an object of the present invention to provide a coupling structure of a case and an air heater body in an air heater that improves the coupling structure between the case and a body of the air heater to enhance the assemblability and fixing force between the case and the air heater body.

To accomplish the above-mentioned object, according to the present invention, there is provided a coupling structure of a case and an air heater body in an air heater, the coupling structure including: an air heater body for generating flames with the fuel supplied from a fuel tank and forcedly blowing the heat of the flames to the outside; the case detachably coupled surroundingly to the air heater body; fastening screws for unitarily coupling the air heater body and the case to each other; coupling flanges formed on both sides of the case in a longitudinal direction of the case and having first screw coupling holes screw-coupled to the fastening screws; and coupling brackets located on two locations on a periphery of the air heater body in the longitudinal direction of the air heater body in such a manner as to come into surface contact with the coupling flanges and having second screw coupling holes formed thereon correspondingly to the first screw coupling holes.

According to the present invention, desirably, each coupling bracket includes a first contact fixing portion coming into surface contact with the external surface of the air heater body and a second contact fixing portion coming into surface contact with the coupling flange.

According to the present invention, desirably, the case includes a lower case and an upper case, the lower case having coupling recesses formed on the coupling flanges thereof, and the second contact fixing portion includes an upper surface contact portion formed on one side thereof in such a manner as to come into surface contact with the top surface of the coupling flange, a lower surface contact portion formed on the other side thereof in such a manner as to come into surface contact with the underside surface of the coupling flange through the coupling recess, and a locking step formed on the boundary between the upper surface contact portion and the lower surface contact portion.

According to the present invention, desirably, the second screw coupling holes are formed on the lower surface contact portion.

According to the present invention, desirably, a contact pad is interposed between each coupling flange and each coupling bracket.

Under the above-mentioned configuration of the structure according to the present invention, the coupling brackets are provided to support the coupling flanges in the state of coming into surface contact with the coupling flanges of the case and to have the second screw coupling holes formed correspondingly to the first screw coupling holes of the coupling flanges, so that the air heater body and the case are fastened to each other by means of one fastening screw, thus reducing the number of assembling parts and further simplifying the assembling process.

Additionally, the second contact fixing portion of each coupling bracket is provided to have the upper surface contact portion and the lower surface contact portion coming into surface with the top and underside surfaces of the coupling flange, so that each coupling bracket can come into contact with the top and underside surfaces of the coupling flange, thus greatly improving the coupling and fixing force to the coupling flange.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Figure 1:
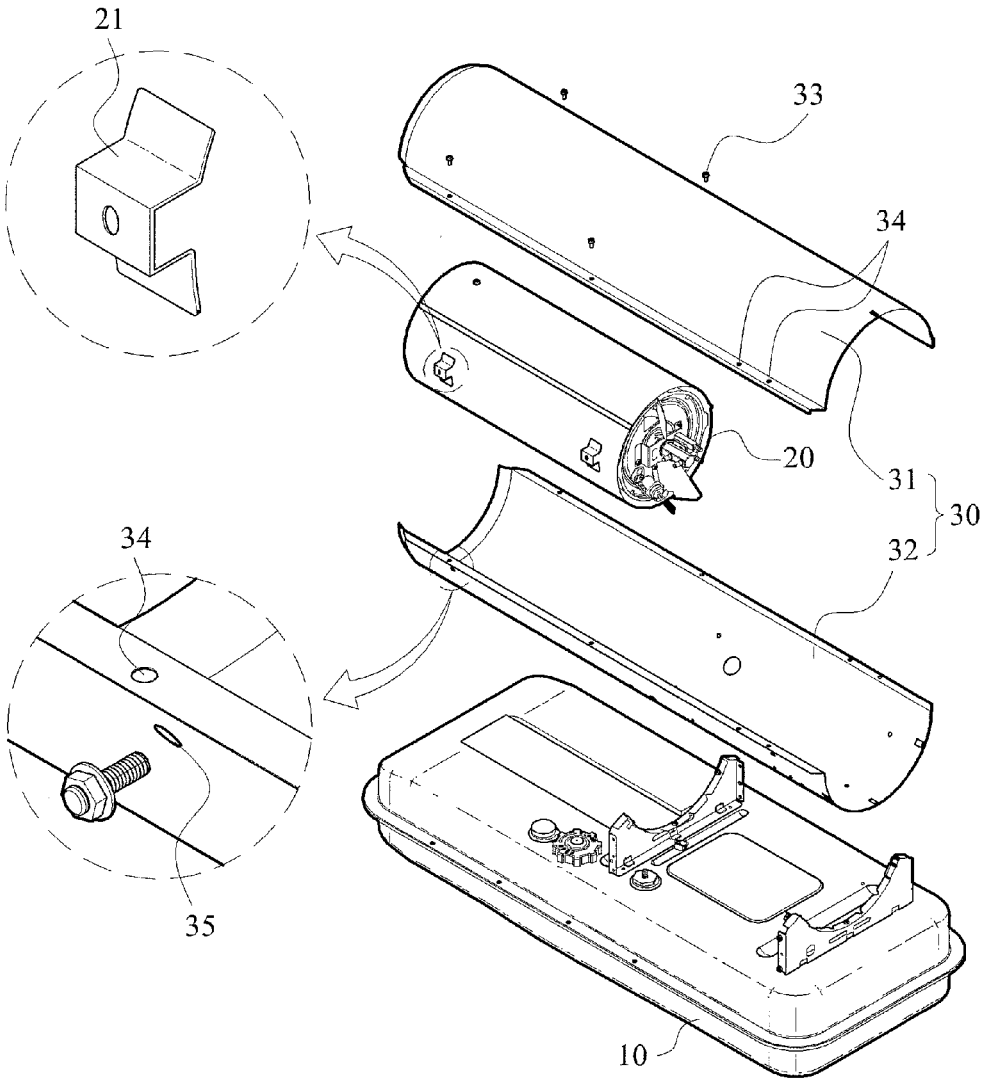
FIG. 1 is an exploded perspective view showing a coupling structure of a case and an air heater body in an air heater in a conventional practice.
Figure 2:
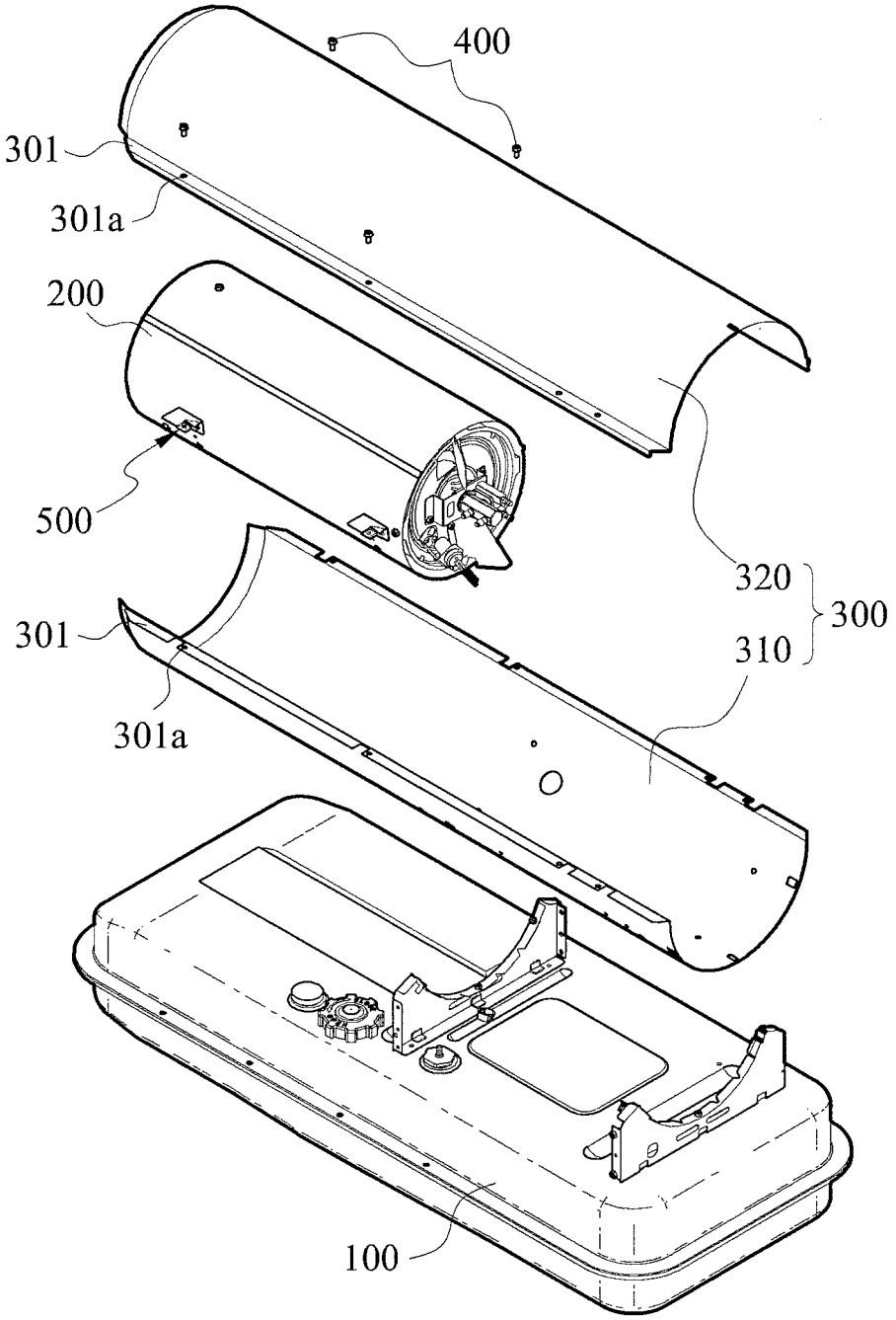
FIG. 2 is an exploded perspective view showing a coupling structure of a case and an air heater body in an air heater according to the present invention.
Figure 3:
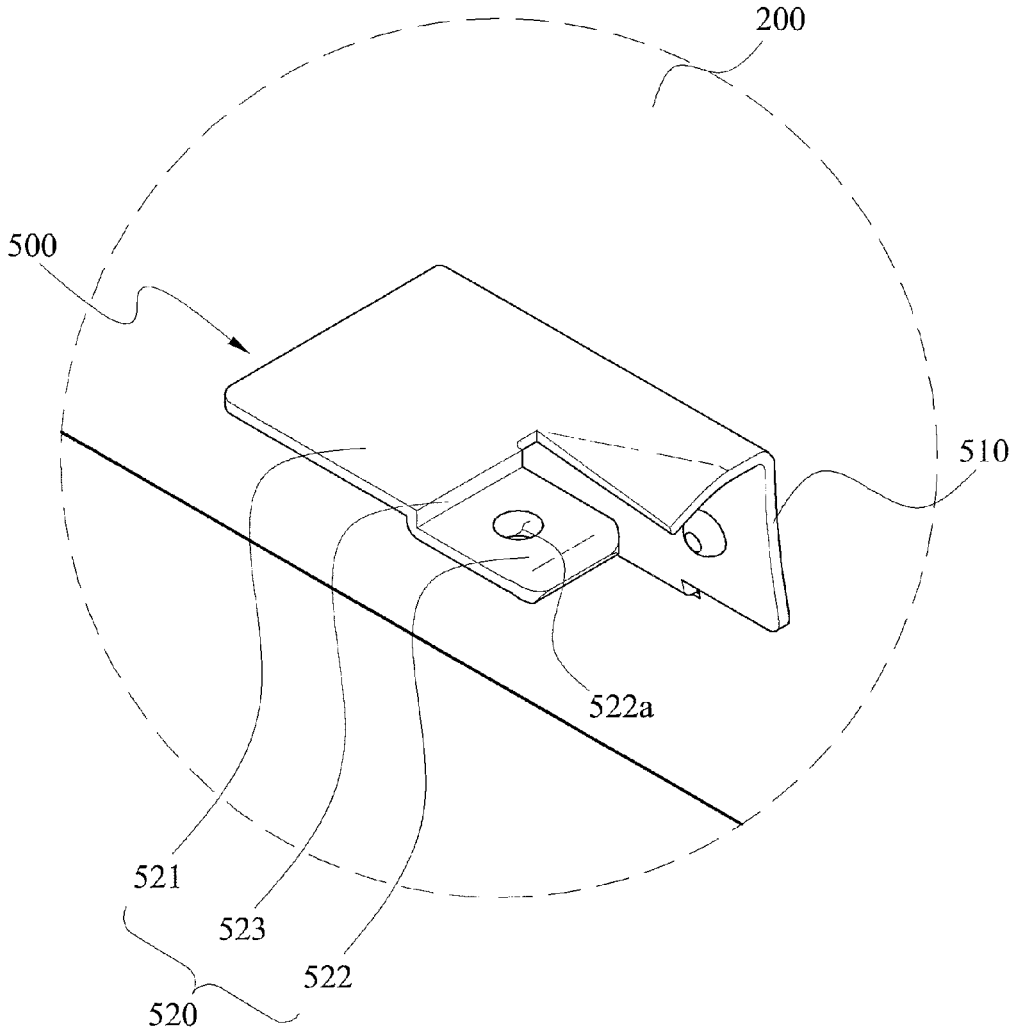
FIG. 3 is an enlarged perspective view showing a coupling bracket of FIG. 2.
Figure 4:
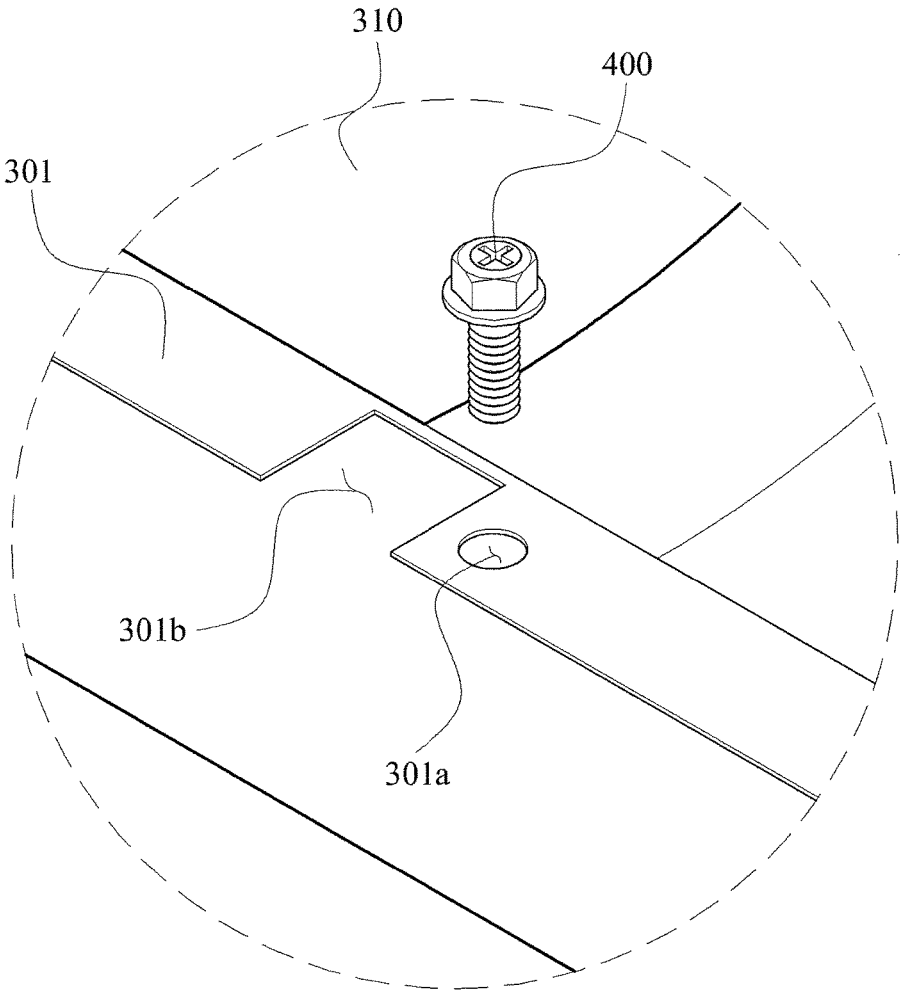
FIG. 4 is an enlarged perspective view showing a coupling flange of FIG. 2.
Figure 5:
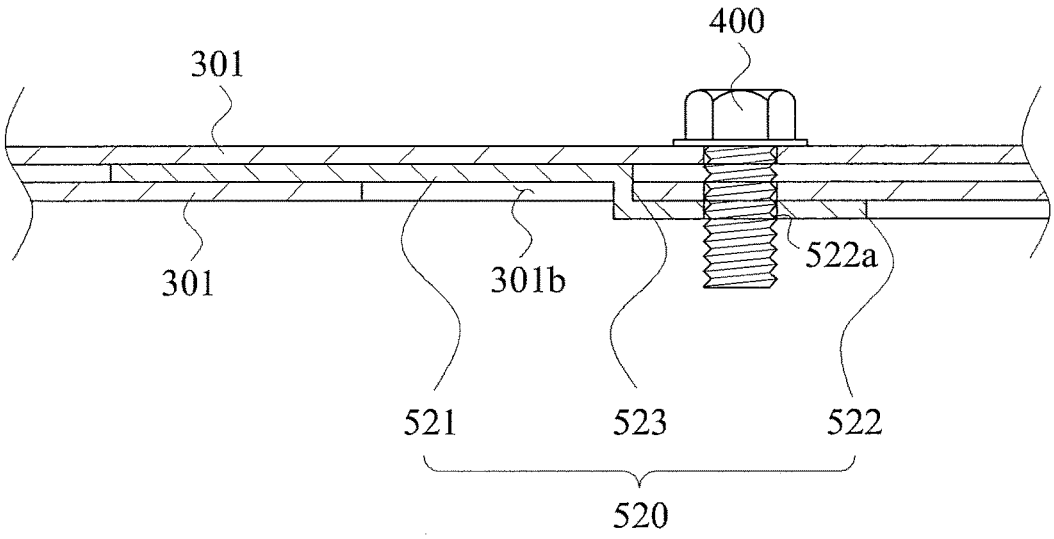
FIG. 5 is a sectional view showing the state wherein the coupling bracket and the coupling flange of FIG. 2 are coupled to each other.

Hereinafter, an explanation on a structure for coupling a case to an air heater according to the present invention will be in detail given with reference to the attached drawing.

As shown in FIGS. 2 to 6*c*, a coupling structure of a case and an air heater body in an air heater according to the present invention includes an air heater body 200 for generating flames with the fuel supplied from a fuel tank 100 and forcedly blowing the heat of the flames to the outside, the case 300 detachably coupled surroundingly to the air heater body 200, and fastening screws 400 for unitarily coupling the air heater body 200 and the case 100 to each other.

The air heater body 200 generates flames with the fuel supplied from a fuel tank 100 to forcedly blow the heat of the flames to the outside so that the hot air can be supplied to some places where heat is required and humidity can be removed from an enclosed space.

The fuel tank 100 is located under the air heater body 200, and the air heater body 200 has a combustion chamber (not shown) formed in the interior thereof to burn fuel supplied from the fuel tank 100. Further, the air heater body 200 has a blower fan (not shown) located in the interior thereof to forcedly blow the heat generated from the combustion chamber to the outside.

The configuration of the air heater body 200 is the same as or similar to that in the conventional practice, and therefore, an explanation on the detailed configuration and operation of the air heater body 200 will be avoided for the brevity of the description.

On the other hand, the case 300 is an assembly detachably coupled surroundingly to the air heater body 200, and accordingly, the case 300 includes a lower case 310 for surrounding the lower periphery of the air heater body 200 and an upper case 320 for surrounding the upper periphery of the air heater body 200.

Further, the case 300 has coupling flanges 301 formed on both sides thereof in a longitudinal direction thereof, and each coupling flange 301 has first screw coupling holes 301*a* screw-coupled to the fastening screws 400 as will be discussed later.

Accordingly, the upper case 320 and the lower case 310 are coupled to each other in the state where the coupling flanges 301 of the upper case 320 come into surface contact with the coupling flanges 301 of the lower case 310.

The first screw coupling holes 301*a* are spaced apart from each other along the longitudinal direction of the coupling flanges 301.

Further, each coupling flange 301 of the lower case 310 has coupling recesses 301*b* formed thereon. The coupling recesses 301*b* are formed near the first screw coupling holes 301*a* so as to fit a portion of each coupling bracket 500 as will be discussed later thereto.

The fastening screws 400 serve as components for unitarily coupling the air heater body 200 and the case 300 to each other, and they are screw-coupled to the first screw coupling holes 301*a* and second screw coupling holes 522*a* of the coupling brackets 500.

On the other hand, the coupling brackets 500 are located on two locations on a periphery of the air heater body 200 in the longitudinal direction of the air heater body 200 in such a manner as to come into surface contact with the coupling flanges 301, and the coupling brackets 500 have the second screw coupling holes 522*a* formed thereon correspondingly to the first screw coupling holes 301*a*.

In more detail, each coupling bracket 500 includes a first contact fixing portion 510 coming into surface contact with the external surface of the air heater body 200 and a second contact fixing portion 520 coming into surface contact with the coupling flange 301.

That is, the first contact fixing portion 510 serves to maintain the rigid fixing state to the air heater body 200, and the second contact fixing portion 520 serves to support the surface contact state with the coupling flange 301.

Figure 6A:
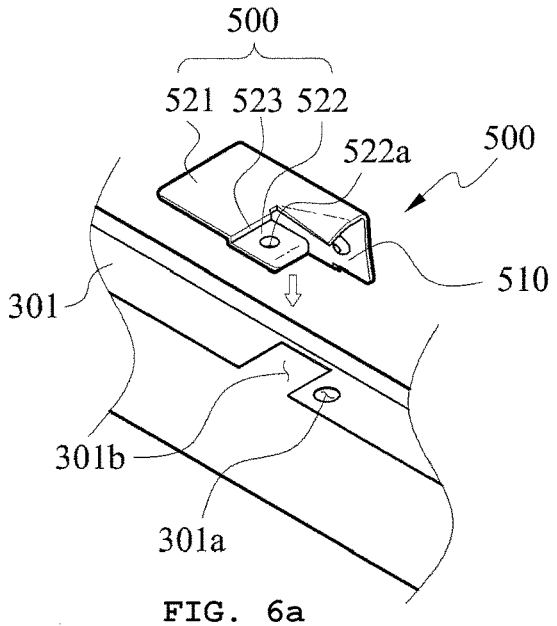
FIGS. 6*a* to 6*c* are perspective views showing the sequential processes for coupling the coupling bracket to the coupling flange in the structure according to the present invention.
Figure 6B:
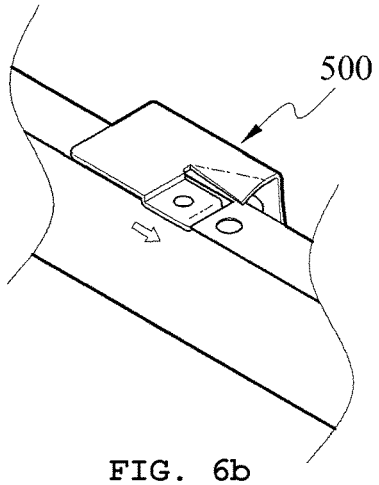
Figure 6C:
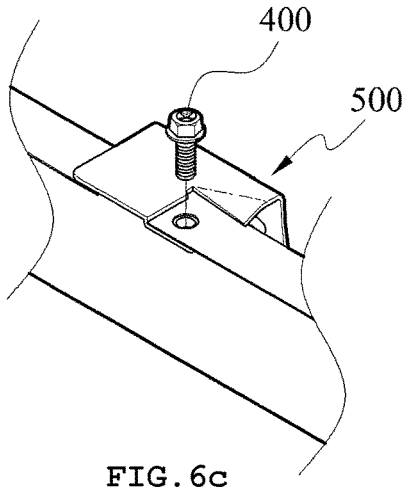

Further, as shown in FIG. 6, the second contact fixing portion 520 includes an upper surface contact portion 521 formed on one side thereof in such a manner as to come into surface contact with the top surface of the coupling flange 301 and a lower surface contact portion 522 formed on the other side thereof in such a manner as to come into surface contact with the underside surface of the coupling flange 301 through the coupling recess 301*b*.

That is, the second contact fixing portion 520 is configured to have the upper surface contact portion 521 located on the top surface of the coupling flange 301 and the lower surface contact portion 522 located on the underside surface of the coupling flange 301 with respect to the coupling recess 301*b* of the coupling flange 301, so that the second contact fixing portion 520 can come into contact with the top and underside surfaces of the coupling flange 301, thus improving the coupling and fixing forces therebetween.

Further, the second contact fixing portion 520 has a locking step 523 formed on the boundary between the upper surface contact portion 521 and the lower surface contact portion 522, and the locking step 523 are maintained in the state of coming into contact with one side end portion of the coupling recess 301*b*.

The formation of the locking step 523 allows the first screw coupling hole 301*a* of the coupling flange 301 and the second screw coupling hole 522*a* of the lower surface contact portion 522 to be located vertically on the same line as each other.

Further, a contact pad (not shown) is interposed between the coupling flange 301 and the coupling bracket 500.

The contact pad serves to enhance a contact pressure between the coupling flange 301 and the coupling bracket 500, and desirably, the contact pad is made of a rubber or silicone material elastically deformable against an external pressure.

Under the above-mentioned configuration of the structure according to the present invention, the coupling brackets 500 are provided to support the coupling flanges 301 in the state of coming into surface contact with the coupling flanges 301 of the case 300 and to have the second screw coupling holes 522*a* formed correspondingly to the first screw coupling holes 301*a* of the coupling flanges 301, so that the air heater body 200 and the case 300 are fastened to each other by means of one fastening screw 400, thus reducing the number of assembling parts and further simplifying the assembling process.

Additionally, the second contact fixing portion 520 of each coupling bracket 500 is provided to have the upper surface contact portion 521 and the lower surface contact portion 521 coming into surface with the top and underside surfaces of the coupling flange 301, so that each coupling bracket 500 can come into contact with the top and underside surfaces of the coupling flange 301, thus greatly improving the coupling and fixing force to the coupling flange 301.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A coupling structure of a case and an air heater body in an air heater, comprising:

the air heater body for generating flames with the fuel supplied from a fuel tank to forcedly and blowing the heat of the flames to the outside;

the case detachably coupled surroundingly to the air heater body;

fastening screws for unitarily coupling the air heater body and the case to each other;

coupling flanges formed on both sides of the case in a longitudinal direction of the case and having first screw coupling holes screw-coupled to the fastening screws; and coupling brackets located on two locations on a periphery of the air heater body in the longitudinal direction of the air heater body in such a manner as to come into surface contact with the coupling flanges and having second screw coupling holes formed thereon correspondingly to the first screw coupling holes, wherein each coupling bracket comprises a first contact fixing portion coming into surface contact with the external surface of the air heater body and a second contact fixing portion coming into surface contact with the coupling flange, and the case comprises a lower case and an upper case, the lower case having coupling recesses formed on the coupling flanges thereof, and the second contact fixing portion comprises an upper surface contact portion formed on one side thereof in such a manner as to come into surface contact with the top surface of the coupling flange, a lower surface contact portion formed on the other side thereof in such a manner as to come into surface contact with the underside surface of the coupling flange through the coupling recess, and a locking step formed on the boundary between the upper surface contact portion and the lower surface contact portion.

2. The coupling structure according to claim 1, wherein the second screw coupling holes are formed on the lower surface contact portion.

3. The coupling structure according to claim 1, wherein a contact pad is interposed between each coupling flange and each coupling bracket.

* * * * *